US006325179B1

(12) United States Patent
Barreiro et al.

(10) Patent No.: US 6,325,179 B1
(45) Date of Patent: Dec. 4, 2001

(54) DETERMINING ELEVATOR BRAKE, TRACTION AND RELATED PERFORMANCE PARAMETERS

(75) Inventors: Juan A. Lence Barreiro, Santiago de Compostela (ES); Harry Z. Huang, Plainville; Chouhwan Moon, Glastonbury, both of CT (US)

(73) Assignee: Otis Elevator Company, Farmington, CT (US)

( * ) Notice: Subject to any disclaimer, the term of this patent is extended or adjusted under 35 U.S.C. 154(b) by 0 days.

(21) Appl. No.: 09/619,464

(22) Filed: Jul. 19, 2000

(51) Int. Cl.[7] ..... B66B 1/34
(52) U.S. Cl. ..... 187/393
(58) Field of Search ..... 187/391–394, 187/414, 284, 287, 291, 288, 247; 340/3.1, 3.43; 700/26, 28, 30, 32; 702/113, 115, 182, 184

(56) References Cited

U.S. PATENT DOCUMENTS 4,698,780 * 10/1987 Mandel et al. ..... 187/29 R
4,898,263 * 2/1990 Manske et al. ..... 187/133
4,936,136 6/1990 Vanhala ..... 73/9
4,936,419 * 6/1990 Stadler et al. ..... 187/101
5,027,299 * 6/1991 Uetani ..... 187/288
5,233,139 * 8/1993 Hofmann ..... 187/133
5,407,028 * 4/1995 Jamieson et al. ..... 187/288
5,557,546 * 9/1996 Fukai et al. ..... 187/391
5,578,801 * 11/1996 Hofmann ..... 187/393

FOREIGN PATENT DOCUMENTS

6239546-A * 8/1994 (JP) .
6271238-A * 9/1994 (JP) .

* cited by examiner

*Primary Examiner*—Jonathan Salata

(57) ABSTRACT

Braking distance ($S_B$) and traction slippage distance ($S_s$) are measured with an empty elevator car (10) traveling upwardly ($S_{BU}$, $S_{SU}$) and downwardly ($S_{BD}$, $S_{SD}$). From these measured distances, the following are calculated and/or determined: maximum and minimum deceleration, $a_{max}$, $a_{min}$, braking force, $F_{BDF}$, available to stop the car when traveling downwardly with a full load; braking force available when traveling upwardly, $F_{BU}$, and downwardly, $F_{BD}$, while empty; difference in braking force provided by two sides of the brake; whether the relationship of traction slippage to tension ratio ((FIG. 5) is within the safe, linear portion or within the unsafe, non-linear portion; and whether leveling errors are caused by faulty brakes, excess traction slippage, or neither.

11 Claims, 5 Drawing Sheets

29

DETERMINING ELEVATOR BRAKE, TRACTION AND RELATED PERFORMANCE PARAMETERS

TECHNICAL FIELD

This invention relates to determining the condition of an elevator brake system, the traction sheaves and ropes, the ability of the elevator to decelerate properly, whether the elevator will stop with full load, and cause of leveling errors.

BACKGROUND ART

It has been common to have elevator mechanics check brake operation visually by determining when the actual braking operation begins by visual measuring of distance. Such a test is subject to human error: for example, an error of only 100 microseconds in determining the actual beginning of the braking operation will result in an error of one quarter of a meter if the elevator speed were 2.5 meters per second. In certain modern elevators operating at 10 meters per second, the error would be a full meter. Such tests also require that the elevator be taken out of service for some period of time. The test can only be performed with a mechanic at the elevator site, and will require between five minutes and twenty minutes of the mechanic's time to carry out the test. Such tests are only qualitative, resulting in pass/fail or poor/fair/good indications of results.

More recently, external devices have been utilized to measure the parameters of the elevator brake system. Such devices are usually quite complex, require additional hardware attached to the elevator, are difficult to operate, and require great expertise in order to interpret the result.

Any of the tests overtly performed with human intervention must be performed according to a schedule, such as at regular intervals of time, or a schedule based upon elevator usage.

DISCLOSURE OF INVENTION

Objects of the invention include determining the condition of an elevator brake system and the traction rope and sheaves, and parameters related thereto: without the need for human intervention; quantitatively, resulting in discrete values which can determine compliance with regulatory code; eliminating errors, including human errors; which can be performed in very short periods of time; which do not require that additional devices be added to the elevator system to make measurements; which provides easily interpreted results; which can be performed and utilized without requiring great expertise; and which, because of its nature, can be performed with substantially any desired frequency, at low maintenance costs and with adequate safety.

Other objects of the invention include provision of simple, automated, quantitative reliable elevator monitoring: that does not require human intervention or the addition of new measuring or sensing devices; which can provide sufficient information to compute the car deceleration for comparison with regulatory codes; to determine if the mechanical brake will stop the elevator with 125% of rated load as required by regulatory codes; to determine the condition of the brake system; to determine the condition of the traction sheave and ropes; and to discern the cause of leveling errors.

According to the present invention, the slipping distance (that is, the difference in the position of the elevator rope drive from the position of the elevator itself as a consequence of traction slippage between the rope and the sheave) as well as the braking distance, (that is, the distance the elevator travels after a command to stop the elevator mechanically by means of the brake) are utilized in energy balance equations and velocity/acceleration/distance equations to determine maximum and minimum car decelerations for comparison with regulatory code requirements, to determine whether the car will be able to stop with 125% rated load, to detect the general condition of the brake system, to determine specific adjustments required to the brake system, to detect the general condition of the traction sheave and ropes, and to determine the cause of leveling errors.

According to the invention, the elevator car, when determined to be empty, is caused to maneuver automatically, including commanded emergency mechanical stops during rated speed runs while noting the settings of a motor position encoder and of a car position encoder, but, if a car position encoder is not available in the system, an additional nominal speed run is made between known distances in the hoistway.

Other objects, features and advantages of the present invention will become more apparent in the light of the following detailed description of exemplary embodiments thereof, as illustrated in the accompanying drawing.

BEST MODE FOR CARRYING OUT THE INVENTION

Figure 1:
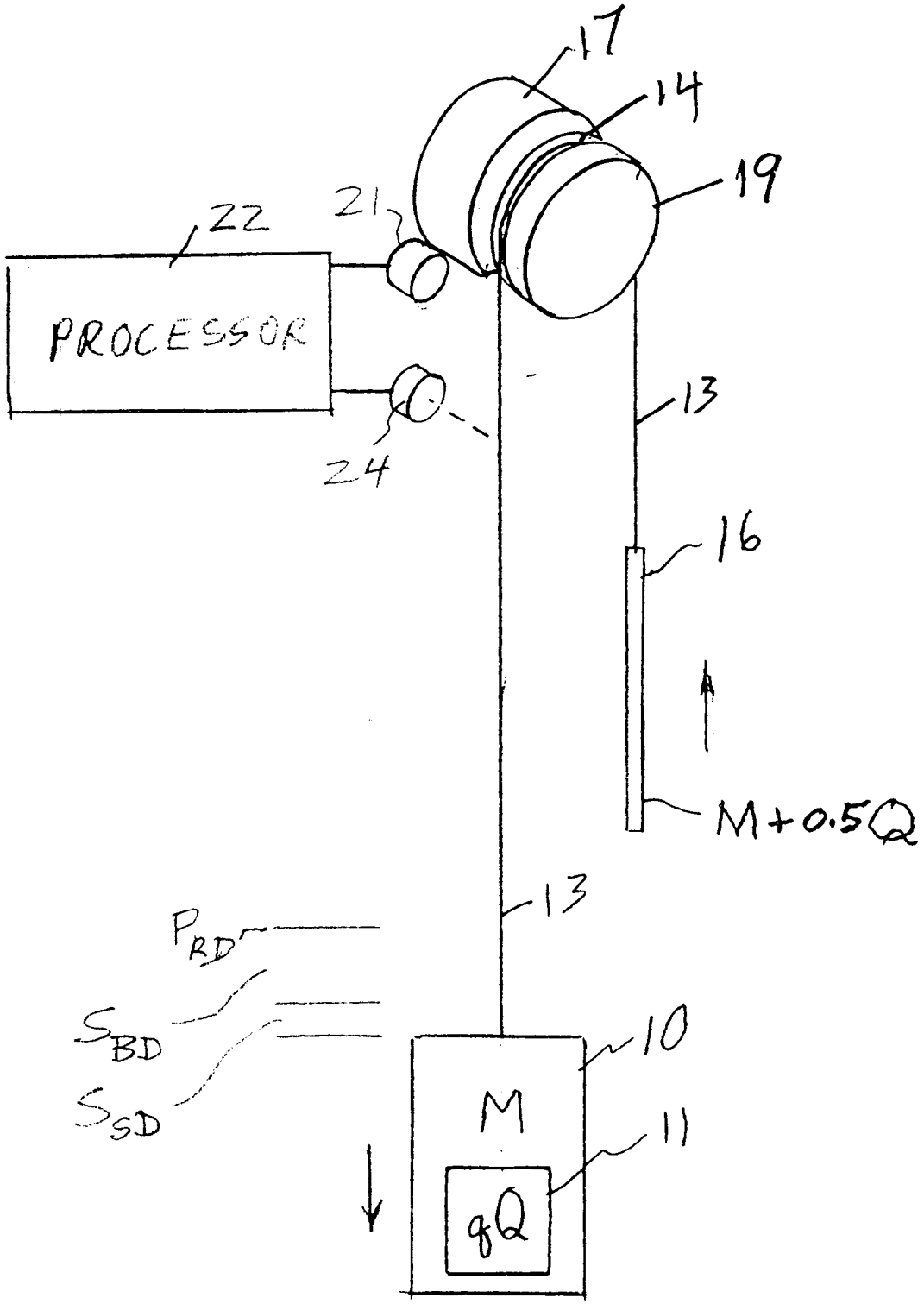
FIG. 1 is a simplified, stylized schematic representation for measuring values of braking and slipping distance in an elevator having a car position encoder, when traveling in the down direction.

Referring to FIG. 1, an elevator car 10 has a mass, M, and is carrying a load 11 which is some fraction, q, of the rated load, Q, of the elevator system. The elevator car 10 is supported by ropes 13 which engage a drive sheave 14 and also support a counterweight 16 whose mass is approximately equal to the mass of the elevator plus half of the rated load of the elevator; in this example, the counterweight has a mass equal to the mass of the elevator plus one-half of the rated load of the elevator, M+0.5Q. The sheave 14 is driven by a motor 17 and, in this example, is directly connected to a drum brake 19, similar to an automobile brake, which has a drum with two internal pads which are normally biased into engagement with the drum by heavy springs, and are caused to disengage the drum by electromagnetic force. There is a motor position encoder 21 coupled to the same shaft as the sheave 14 (typically through the motor 17) which produces pulses indicative of motor position to a processor 22. A car position encoder 24 is coupled to a tape (not shown) that runs in synchronism with the ropes 13 and provides a signal indicative of car position to the processor 22. The description thus far is of an elevator system known to the prior art. The elevator has two main frictions. The friction between the brake drum and the brake shoes when the brake is engaged is referred to herein as "braking friction". When the elevator car is carrying 125% of its rated load, the brake must be able to hold the elevator at rest and it must be able to stop the elevator when it is traveling at rated speed. In elevators without closed-loop electric leveling, the braking friction also determines the leveling accuracy and ride comfort. The friction between the drive sheave and the ropes, referred to as "traction", is the only relationship between the machine's braking and driving capabilities and the car/counterweight system. Insufficient friction between the ropes and the sheave can lead to dangerous conditions. Both the braking friction and the traction vary considerably during the lifetime of an elevator.

The brake friction depends on the brake adjustment, the condition of the brake drum, including irregularities in its surface, oil on its surface, etc.; the condition of the brake shoes, particularly brake shoe wear and crystallization; and aging, including change in the elastic constant of the brake springs. Traction depends mainly on aging, particularly groove wear and reductions in rope diameter, both of which are exacerbated by bad brake adjustment or bad rope equalization. Traction also depends on fluctuations in the lubrication conditions between the rope and the sheave, and differing tolerances resulting from drive sheave regrooving and/or by rope replacement.

The present invention utilizes the motor position encoder that most modern elevators have to provide feedback to the motor drive, and in those systems that have them, the invention takes advantage of the car position sensing system.

Referring to FIG. 1, an elevator car can be assured to be empty by having the elevator parked with its doors closed and with no activity on the car buttons for more than twenty minutes. The elevator car is then moved to the top floor in parking mode which assures that it will remain empty. Then the elevator car is moved downward from the top floor at nominal speed, $V_0$. At some selected reference position, $P_{RD}$, for a down direction test, determined by the car position encoder, the values of both the car position encoder and the motor position encoder are recorded $$S_{0CD}=P_{RD}=\text{Car Position Encoder Value}$$

$$S_{0BD}=\text{Motor Position Encoder Value}$$

and an emergency stop, a mechanical stop utilizing the brake, is commanded. After waiting several seconds to ensure that the car is stopped, both of the position encoders are again read $$S_{1CD}=\text{Car Position Encoder Value}$$

$$S_{1BD}=\text{Motor Position Encoder Value}$$

The values of the braking distance, $S_{BD}$, and the slipping distance, $S_{SD}$, in the down direction are determined and stored:

$$S_{BD}=S_{1BD}-S_{0BD}$$

$$S_{SD}=S_{1CD}-S_{0CD}-S_{BD}$$

These tests are performed with the car empty, so that q in FIG. 1 is zero.

Figure 2:
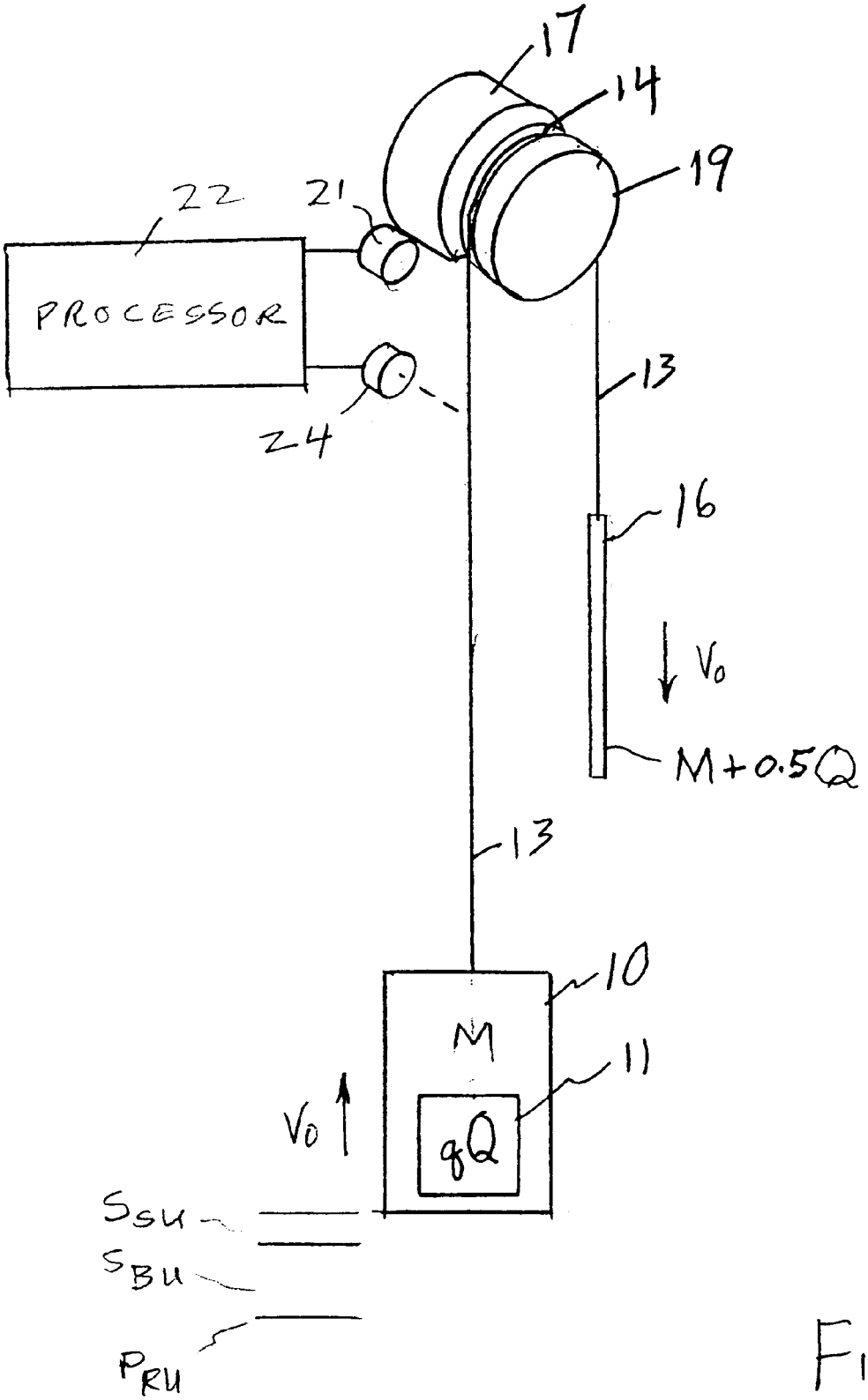
FIG. 2 is a simplified, stylized schematic representation for measuring values of braking and slipping distance in an elevator having a car position encoder, when traveling in the up direction.

Referring to FIG. 2, a similar test is performed for the elevator traveling upwardly at a nominal speed, $V_0$, with the counterweight 16 traveling downwardly at a nominal speed, $V_0$; again, the test is performed with the car empty so that q in FIG. 2 is zero. In a similar fashion at some reference point, $P_{RU}$, the value of the car position encoder and the motor position encoder are recorded $$S_{0CU}=P_{RU}=\text{Car Position Encoder Value}$$

$$S_{0BU}=\text{Motor Position Encoder Value}$$

and an emergency mechanical stop, using the brake, is commanded.

After waiting a few seconds to ensure that the car has stopped, both encoder values are again read $$S_{1CU}=\text{Car Position Encoder Value}$$

$$S_{1BU}=\text{Motor Position Encoder Value.}$$

The values of the braking distance and slipping distance in the upward direction are then determined and stored $$S_{BU}=S_{1BU}-S_{0BU}$$

$$S_{SU}=S_{1CU}-S_{0CU}=S_{BU}$$

Figure 3:
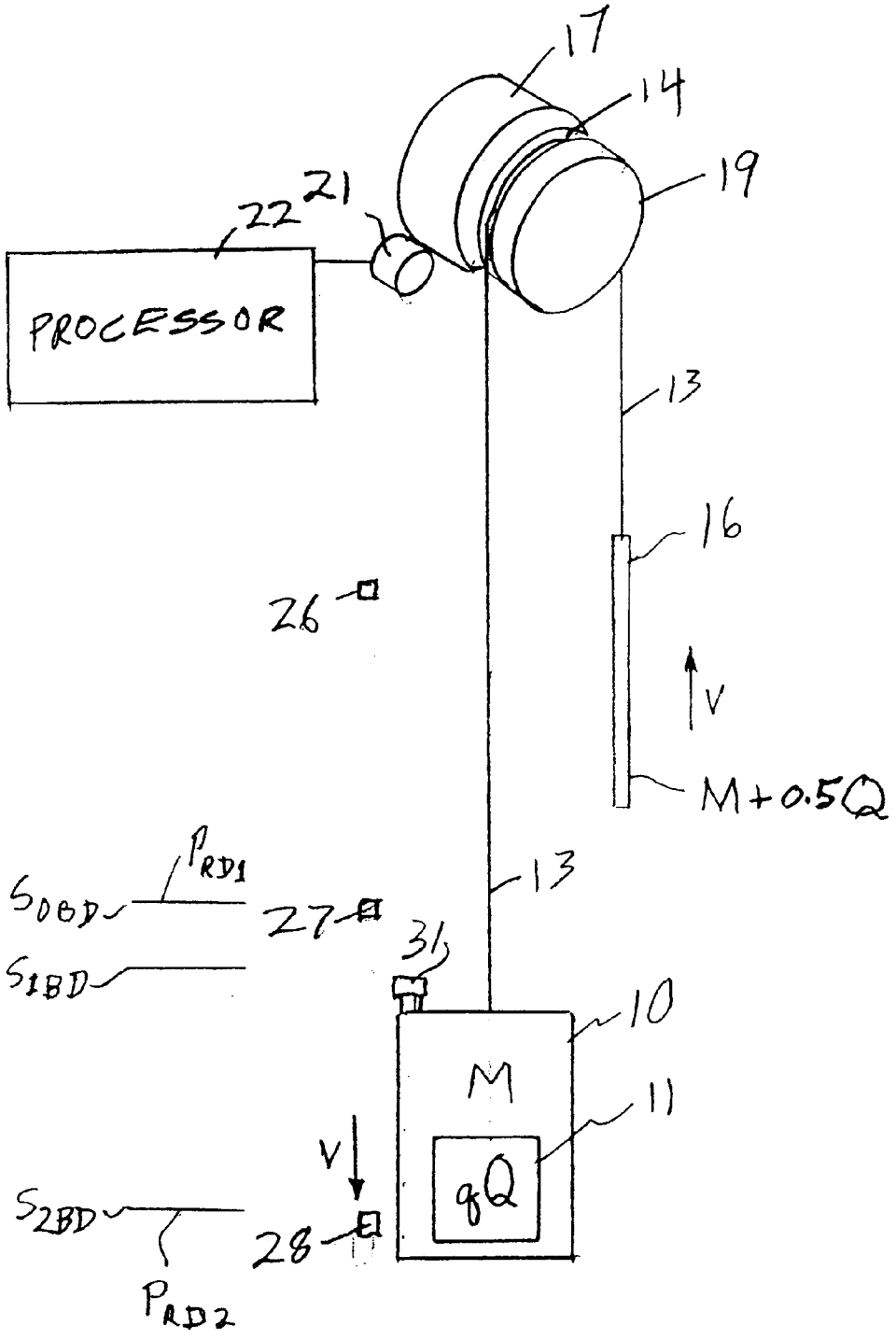
FIG. 3 is a simplified, stylized schematic representation for measuring values of braking and slipping distance in an elevator not having a car position encoder, when traveling in the down direction.

Referring now to FIG. 3, in some elevator systems, particularly those that do not have a large number of floors, there may not be a car position transducer 24 as illustrated in FIGS. 1 and 2. Therefore, the invention also provides for determining braking and slipping distances utilizing indicators of hoistway position which are already present in the hoistway. In this example, a plurality of door zone and leveling vanes or magnets 26–29 are illustrated, but other switches, such as terminal landing limit switches may be used if desired. In FIG. 3, a hoistway position reader box 31 is mounted on the elevator so as to detect the magnets or optical vanes 26–29. On the other hand, mechanical vanes and switches, if such are available in the elevator shaft, may be used.

With an elevator of the type illustrated in FIG. 3, the process may start with the elevator 10 parked at the top floor, as indicated by the magnets or vanes 26, with the door closed and the car empty. Then the car is moved downwardly at a nominal speed, such as rated speed, until the hoistway position reader 31 senses the next vane or magnet 27, which comprises a first downward reference position, $P_{RD1}$. At that point, the first position, $S_{0BD}$, of the motor position encoder is recorded, and an emergency mechanical stop using the brake is commanded. After waiting several seconds to ensure that the car has stopped, a second motor position encoder value, $S_{1BD}$, is recorded. Then the car is moved downwardly at low speed and low acceleration to the next reference point, which in this example is the magnet or vane 28 ($P_{RD2}$) where a third motor position encoder value, $S_{2BD}$, is recorded. The distance between $P_{RD1}$ and $P_{RD2}$ must be measured and stored in the system. Then, the values of the braking distance and slipping distance in the downward direction are stored $$S_{BD}=S_{1BD}-S_{0BD}$$

$$S_{SD}=P_{RD2}-P_{RD1}-(S_{2BD}-S_{0BD})$$

Figure 4:
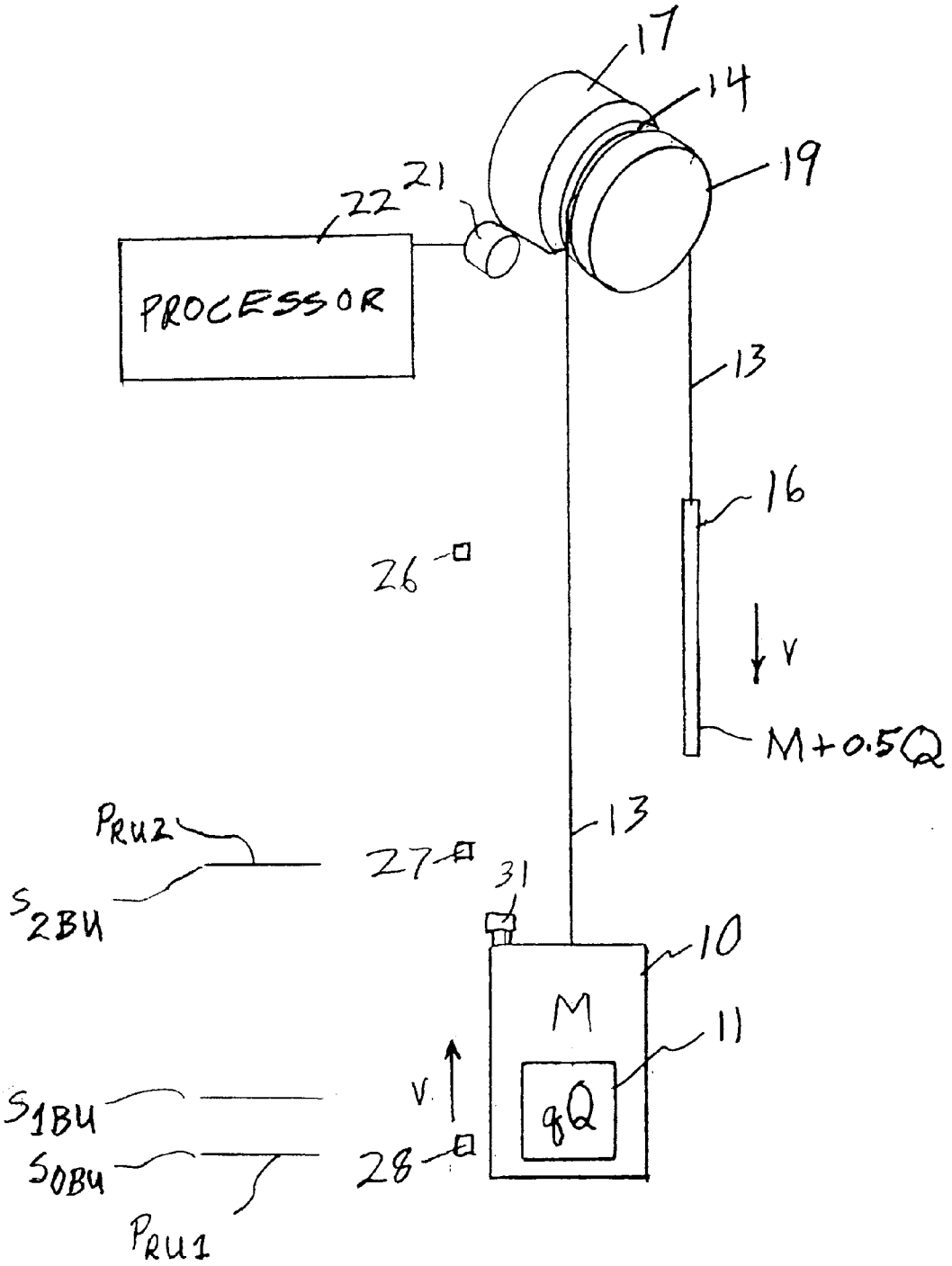
FIG. 4 is a simplified, stylized schematic representation for measuring values of braking and slipping distance in an elevator not having a car position encoder, when traveling in the up direction.

Referring to FIG. 4, a method similar to that described with respect to FIG. 3, except that the car is traveling upward, takes a motor position encoder reading, $S_{0BU}$, at a first reference point in the up direction, which in this example is the magnet or vane 28, initiates an emergency mechanical stop involving the brake at that point, allows a few seconds time to pass to be sure the elevator is stopped and then takes a second motor position encoder reading, $S_{1BU}$. Then the elevator is caused to rise slowly until it reaches a second up reference point, $P_{RU2}$, which may be the magnet or vane 27, and takes a third motor position encoder reading, $S_{2BU}$. Now values of braking distance and slipping distance in the upper direction are stored as follows:

$$S_{BU}=S_{1BU}-S_{0BU}$$

$$S_{SU}=P_{RU2}-P_{RU1}-(S_{2BU}-S_{0BU})$$

With an empty elevator, the counterweight typically weighs about half of the nominal load (0.5Q) more than the elevator (M), so when traveling downwardly, the extra weight of the counterweight aids the car in stopping. Therefore, the safe thing to do is to perform the test with the car traveling downwardly prior to performing the test with the car traveling upwardly. In this way, it can be determined that there are safe braking conditions for upward travel.

In both methods described hereinbefore, the position of reference for upward direction $P_{RU1}$ is the highest possible that allows the elevator to decelerate safely since the test should in all events end at the top floor landing, the maximum value relates to the height of the top floor $H_{max}$, the nominal speed, and the results of prior tests.

$$P_{RU1max}=H_{max}-V_0^2 a_{min}$$

where $a_{min}$ is the minimum of 0.35 g and the acceleration involved in the prior test.

The present invention uses the balance of energy equation for the case where the elevator performs an emergency mechanical stop with the car moving downward. For simplicity, it is assumed that all of the masses are concentrated in either the car or the counterweight, and that the braking force is acting directly on the traction sheave. The equation is:

$$E_c+E_p-E_{cal}=E_B \quad \text{Eq. 1}$$

where:

$E_c$=Kinetic energy of car/counterweight system $$E_c=[2M+(q+0.5)Q][V_0^2/2] \quad \text{Eq. 2}$$

$E_p$=Potential energy of car/counterweight system $$E_p=(q-0.5)Qg(S_B+S_S) \quad \text{Eq. 3}$$

$E_{cal}$=Thermal energy lost as friction between sheave and rope $$E_{cal}=F_T S_S \quad \text{Eq. 4}$$

$E_B$=Thermal energy lost as brake/shoe friction $$E_B=F_B S_B \quad \text{Eq. 5}$$

and

M=car mass, Kg

Q=mass of rated load, Kg

M+0.5Q=mass of counterweight q=fraction of rated load in car $F_T$=frictional force between sheave and rope $F_B$=frictional force between brake and shoe $V_0$=rated speed g=acceleration of gravity=9.81 m/sec$^2$ Substituting Equations 2–5 into Equation 1:

$$[2M+(q+0.5)Q]V_0^2/2+(q-0.5)Qg(S_{BD}+S_{SD})-F_T S_{SD}=F_B S_{BD} \quad \text{Eq. 6}$$

$$S_{BD}=[(V_0^2/2)][2M+(q+0.5)Q]+((q-0.5)Q_g-F_T)S_{SD}]/[F_B-(q-0.5)Qg] \quad \text{Eq. 7}$$

and similarly, when the car is moving upward, the braking distance is $$S_{BU}=[V_o^2/2)][2M+(q+0.5)Q]-[+((q-0.5)Q_{g+Ft})\ S_{SU}/[F_B+(q-0.5)Qg] \quad \text{Eq. 8}$$

The negative acceleration, a, needed to stop the car is related to the nominal or rated velocity of the car when the emergency stop is commenced, and the final velocity, $V_f$:

$$V_f=V_0-\text{at, but } V_f=0\text{, so } t=Vo/a \quad \text{Eq. 9}$$

The distance needed to stop is:

$$S_s+S_b=V_0 t-½(\text{at}^2) \quad \text{Eq. 10}$$

or $$a=V_0^2/[2(S_s+S_B)] \quad \text{Eq. 11}$$

To determine if car deceleration falls within the range permitted by regulatory codes, the maximum and minimum decelerations are determined and compared with the range in the codes:

$$a_{max}=V_0^2/2(S_{BD}+S_{SD}) \quad \text{Eq. 12}$$

$$a_{min}=V_0^2/2(S_{BU}+S_{SU}) \quad \text{Eq. 13}$$

This is a first important aspect of the invention.

At any point in time, the sheave/rope traction depends on the condition of the sheave grooves and the condition of the rope, as well as the difference between the tension in the rope on the car side and the tension in the rope on the counterweight side. Consider a car moving downward with the load in the car equal to 125% of rated load, so that the rope tension in the car side is greater than the rope tension in the counterweight side; in this circumstance, $T_1$ is on the car side and $T_2$ is on the counterweight side in the conventional relationship $T_1/T_2$. The rope tensions are:

$$T_1=(M+qQ)g+(M+qQ)a=(M+qQ)(g+a) \quad \text{Eq. 14}$$

$$T_2=(M+0.5Q)g-(M+0.5Q)a=(M+0.5Q)(g-a) \quad \text{Eq. 15}$$

$$T_1/T_2=\frac{M+qQg+a}{M+0.5Qg-a}(\text{down, } q>0.5) \quad \text{Eq. 16}$$

Using a factor, C, to express the effect of the conditions between the sheave and the rope, the relation for the down direction becomes:

$$T_1/T_2=\frac{M+qQg+a_D}{M+0.5Qg-a_D}C \quad \text{Eq. 17}$$

and similarly, the relation $T_1/T_2$ for the upward direction with the car empty, bearing in mind that the larger tension is now on the counterweight side so that $T_1$ is on the counterweight side:

$$T_1/T_2 = \frac{M + 0.5Qg + a_u}{M + qQg - a_u} C(\text{up},\ q > 0.5) \quad \text{Eq. 18}$$

Since all of the foregoing tests are performed with the car empty, a methodology is required to determine stopping conditions for a car that is as fully loaded as it can be, which is assumed to be 125% of rated load (1.25Q). The methodology of the present invention takes into account that the rope/sheave conditions and therefore the relation $T_1/T_2$ for an empty car moving upward is quite close to the relation $T_1/T_2$ for a car moving downward with 125% of rated load. This is shown by comparing Equation 17 when q=0 with Equation 18 with q equal to 1.25: in making this comparison, the rope sheave condition represented by C remains the same in both the up and down directions because the test does not introduce any change in the groove rope conditions, and gravity does not change.

Assume that the mass of the elevator, M, is 130% of the mass of the load, Q; the resulting ratio of $T_1/T_2$, up direction, with q=0, here called Ta, to the ratio $T_1/T_2$, down direction, with q=1.25, here called Tb, is:

$$\frac{Ta}{Tb} = \frac{(1.3Q + 0.5Q)2}{1.3Q(1.3Q + 1.25Q)} \frac{g + a_u}{g - a_u} \frac{g - a_D}{g + a_D} = 0.977 \frac{g + a_u}{g - a_u} \frac{g - a_D}{g + a_D} \quad \text{Eq. 20}$$

Since the braking force is dependent on the conditions of the brake and is independent of the load in the car, the relation between $a_U$ and $a_D$ can be estimated as follows, where $m_U$=mass when traveling upwardly and $m_D$=mass when traveling downwardly, $m_C$=mass of counterweight, $m_E$=mass of empty car, and $m_L$=mass of car with 1.25% rated load $$F_B = m_U a_U = m_D a_D$$

$$m_U = m_C - m_E = M + 0.5Q - M = 0.5Q$$

$$m_D = m_F - m_C = M + 0.5Q - (M + 1.25Q) = 0.75Q$$

Therefore, $m_D = 1.5\ m_U$ and thus $a_U = 1.5a_D$, and depending on $a_U$, the relation between traction ratios will be in a range:

$$0.91 < \frac{T_a}{T_b} < 1.1$$

Thus, the braking conditions for traveling up when empty are nearly the same as the braking conditions when traveling down with a full load. Therefore, the braking force, $F_B$, for traveling down with a full load can be estimated from Equation 8, with q=0 and assuming $S_{SU}$ is zero (i.e., assuming the brake is applied directly to the rope:)

$$F_{BDF} = [(V_0^2/2)(2M + 0.5Q)/S_{BU}] - 0.5Qg \quad \text{Eq. 21}$$

This is an important aspect of the present invention.

In accordance with another aspect of the present invention, the performance of the brake system can be inferred from the values of $S_{BD}$ and $S_{BU}$, the measurements for these two factors are achieved with the car empty, so in the following, q is taken as zero valued: for the following determination, it is also assumed that the brake operates directly on the rope, and therefore $S_{SD}$ and $S_{SU}$ both are zero valued. From Equations 7 and 8, simplified with the foregoing constraints:

$$F_{BD} = [(V_0^2/2)(2M + 0.5Q)/S_{BD}] - 0.5Qg \quad \text{Eq. 22}$$

$$F_{BU} = [(V_0^2/2)(2M + 0.5Q)/S_{BU}] + 0.5Qg \quad \text{Eq. 23}$$

As the brake shoes wear, $F_B$ decreases slowly in relationship to the wear. Therefore, instead of scheduling brake adjustment based on the number of elevator runs, or based on a period of time, use of the present invention allows setting a minimum threshold for the automatically calculated value, $F_B$, below which a brake adjustment operation is scheduled. This is an important aspect of the invention.

Most modern elevators either utilize drum brakes or disc brakes, which have two brake shoes. It has been known that one of the shoes (depending upon the clockwise, anti-clockwise relationship to the up and down directions) is responsible for 0.7 $F_{BD}$ while the opposite shoe is responsible only for 0.3 $F_{BD}$. When the car goes in the opposite direction, the wear on the shoes changes. Thus, though in general the wear should equalize with the two shoes, in practice, that is not the case. According to the invention, by comparing the braking force in the upward direction $F_{BU}$ with the braking force in the downward direction $F_{BD}$, the brake shoe that is in need of more adjustment is determined. Well adjusted brakes result in $F_{BU}$ equaling $F_{BD}$. This is an important aspect of the invention.

Figure 5:
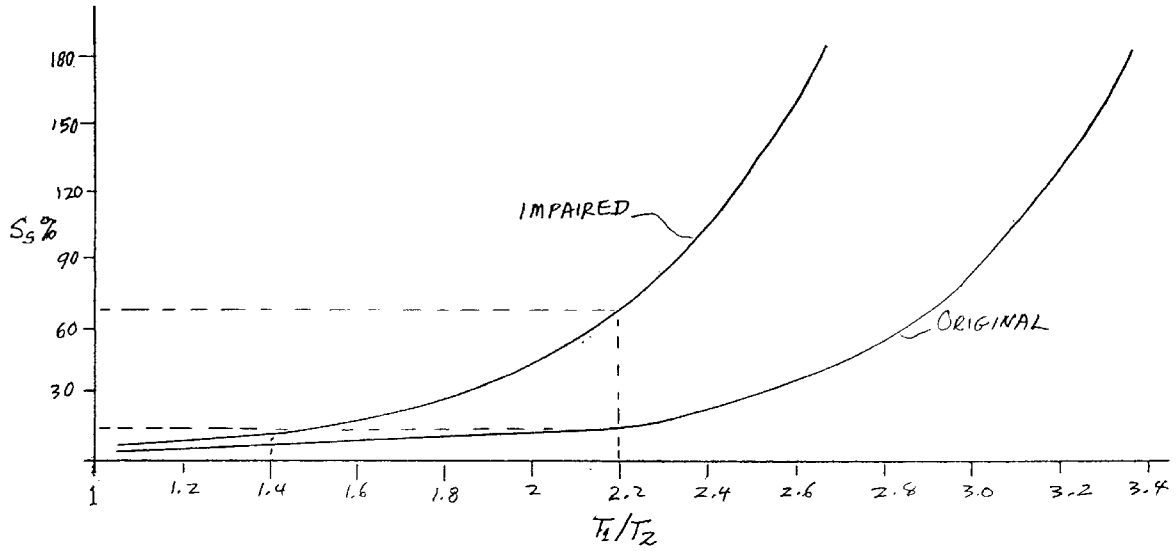
FIG. 5 is a plot of traction slipping distance as a function of the ratio of tensile forces on both sides of the drive sheave, expressed as T1/T2.

Referring to FIG. 5, the amount of slipping distance expressed as a percent of driving rope distance traveled, $S_S$, as a function of the ratio of tensions in the rope, $T_1/T_2$, is illustrated for original traction conditions, such as when the rope and the sheave are new and are properly lubricated, as well as for impaired rope/sheave conditions, which may result from a variety of factors including aging and lubrication. It can be seen that under the original conditions, the relationship of $S_S$ to the tension ratio is linear to ratio values of about 2.2. On the other hand, with a severely impaired rope/sheave relationship, the value of $S_S$ as a function of the tension ratio is linear only to a certain value (in this example about 1.4), and at ratio values of 2.2, the slippage (in this example) is nearly 70% under impaired conditions but is only about 15% under original conditions. As is known, the elevator should be operated only in the linear region, because the increase in slippage as a function of impaired rope/sheave relationship is dangerous, and results in sub-standard operation of the elevator.

According to the invention, the condition of the rope/sheave relationship can be determined simply by relating the ratio of the measured slippage distances for an empty car in the up and down directions with the ratio of the tension ratio for the up direction to the tension ratio for the down direction, for an empty car. Thus:

$$\frac{S_{SU}}{S_{SD}} = k \frac{(T_1/T_2)_{UP}}{(T_1/T_2)_{DN}} \quad \text{Eq. 24}$$

but $(T_1/T_2)_{UP}$ and $(T_1/T_2)_{DN}$ are both known, so the value of k can be estimated and compared with the expected value to know if the system is working in the linear region of the relationship (FIG. 5) or in the exponential region. The constant, K, is determined from a new elevator of the same type as the one being tested, such as the same elevator. In accordance with the invention, when the ratio of slipping distances to the tension ratios, k, is greater, by a threshold amount, i.e.:

$$k > \text{Threshold}, \quad \text{Eq. 25}$$

that indicates that operation is in a non-linear region of the relationship between the ratio of tensions and the slipping distance, thereby indicating an impaired condition of the rope/sheave relationship. This is an important aspect of the present invention. The inverse ratios could be used, if desired.

In elevators, a leveling error may be detected by automatic monitoring equipment even in a case where the error is only caused by an overload of the elevator. As a consequence of such detection, a correction run may be ordered, and that in turn will be stored in an error memory log as an error.

According further to the invention, the nature of leveling errors can be determined by examination of the indicated condition of the brake system, as determined in Equations 7 and 8, and the condition of the rope/sheave relationship, as determined in Equation 25, the cause of leveling errors can be determined to be the result of poor brakes, one brake shoe or the other being well out of condition, or extremely poor traction. This is an important aspect of the present invention.

In the examples herein, the counterweight is assumed to have a mass which is equal to the mass of the car (M) when it is carrying one-half of its rated load (0.05Q). However, the total mass of the car plus counterweight, expressed as 2M+0.5Q, and the value expressed as 0.5Q herein, in any practice of the invention, may be of a different actual mass.

The measurement of braking distance and tension slippage may be performed in ways other than those disclosed herein.

Thus, although the invention has been shown and described with respect to exemplary embodiments thereof, it should be understood by those skilled in the art that the foregoing and various other changes, omissions and additions may be made therein and thereto, without departing from the spirit and scope of the invention.

We claim:

1. A diagnostic method for an elevator having a car and a counterweight connected to said car by a rope driven by a sheave having a brake comprising:

measuring the distance, $S_{BU}$, required to stop the car when traveling upwardly at rated speed, $V_0$, while the car is empty; and calculating the force, $F_{BDF}$, required to stop the car when traveling downwardly, at rated speed, $V_0$, while fully loaded with 125% of rated load, Q, as $$F_{BDF}=[(V_0^2/2)(2M+0.5Q)/S_{BU}]-0.5Qg,$$

where 2M+0.5Q is the total mass of the empty car and the counterweight, 0.5Q is substantially the amount of mass by which the mass of the counterweight exceeds the mass of the car when empty, and g is the acceleration of gravity.

2. A diagnostic method for an elevator having a car and a counterweight connected to said car by a rope driven by a sheave having a brake, comprising:

measuring the distance, $S_{BU}$, required to stop the car when traveling upwardly at rated speed, $V_0$, while the car is empty;

measuring the distance, $S_{BD}$, required to stop the car when traveling downwardly at rated speed while the car is empty;

calculating the braking force, $F_{BU}$, required to stop the car while traveling upwardly while the car is empty as $$F_{BU}=[(V_0^2/2)(2M+0.5Q)/S_{BU}]+0.5Qg$$

calculating the braking force, $F_{BD}$, required to stop the car while traveling downwardly while the car is empty as $$F_{BD}=[(V_0^2/2)(2M+0.5Q)/S_{BD}]-0.5Qg$$

where: 2M+0.5Q is the total mass of the car plus counterweight, 0.5Q is substantially the amount of mass by which the mass of the counterweight exceeds the mass of the car when empty, and g is the acceleration of gravity;

comparing said braking forces $F_{BU}$ and $F_{BD}$ to a predetermined braking force threshold magnitude; and providing a force indication that servicing of the brake is necessary in the event that either said brake force $F_{BU}$ or said brake force $F_{BD}$ is less than said force threshold magnitude, but otherwise not providing said force indication.

3. A diagnostic method for an elevator having a car and a counterweight connected to said car by a rope driven by a sheave having a brake, comprising:

measuring the distance, $S_{BU}$, required to stop the car when traveling upwardly at rated speed, $V_0$, while the car is empty;

measuring the distance, $S_{BD}$, required to stop the car when traveling downwardly at rated speed while the car is empty;

calculating the braking force, $F_{BU}$, required to stop the car while traveling upward empty as $$F_{BU}=[(V_0^2/2)(2M+0.5Q)/S_{BU}]+0.5Qg$$

calculating the braking force, $F_{BD}$, required to stop the car while traveling downward empty as $$F_{BD}=[(V_0^2/2)(2M+0.5Q)/S_{BD}]-0.5Qg$$

where: 2M+0.5Q is the total mass of the car plus counterweight, 0.5Q is substantially the amount of mass by which the mass of the counterweight exceeds the mass of the car when empty, and g is the acceleration of gravity;

comparing said braking force $F_{BU}$ with said braking force $F_{BD}$, and adjusting at least one element of said brake in response to said comparison.

4. A diagnostic method for an elevator having a car and a counterweight connected to said car by a rope driven by a sheave having a brake, comprising:

measuring the distance, $S_{BU}$, required to stop the car when traveling upwardly at rated speed, $V_0$, while the car is empty;

measuring the distance, $S_{BD}$, required to stop the car when traveling downwardly at rated speed while the car is empty;

calculating the braking force, $F_{BU}$, required to stop the car while traveling upwardly empty as $$F_{BU}=[(V_0^2/2)(2M+0.5Q)/S_{BU}]+0.5Qg$$

calculating the braking force, $F_{BD}$, required to stop the car while traveling downwardly while empty as $$F_{BD}=[(V_0^2/2)(2M+0.5Q)/S_{BD}]-0.5Qg$$

where: 2M+0.5Q is the total mass of the car plus counterweight, 0.5Q is substantially the amount of mass by which the mass of the counterweight exceeds the mass of the car when empty, and g is the acceleration of gravity;

comparing the difference between said braking force $F_{BU}$ and said braking force $F_{BD}$ with a predetermined difference threshold magnitude; and if said difference exceeds said difference threshold magnitude, providing a brake difference indication that at least one element of said brake needs adjusting, but otherwise not providing said brake difference indication.

5. A diagnostic method for an elevator having a car and a counterweight connected to said car by a rope driven by a sheave comprising:

measuring the distance, $S_{SU}$, which the rope slips with respect to the sheave over a finite distance, expressed as a ratio of slippage distance to finite distance, with the car traveling upwardly while empty;

measuring the distance, $S_{SD}$, which the rope slips with respect to the sheave over a finite distance, expressed as a ratio of slippage distance to finite distance, with the car traveling downwardly while empty;

providing a combined slippage ratio as the ratio of one of said ratios of slippage distance to the other of said ratios of slippage distance;

determining an up ratio of tension in the rope on the car side to tension in the rope on the counterweight side when the car is traveling up;

determining a down ratio of tension in the rope on the car side to tension in the rope on the counterweight side when the car is traveling down;

determining a combined tension ratio as the ratio of one of said tension ratios to the other of said tension ratios;

estimating a factor, k, as the ratio of (a) said combined slippage ratio provided from said distance $S_{SU}$ and said distance $S_{SD}$ measured for a new elevator of the same type as said elevator, to (b) said combined tension ratio; and if a currently-provided value of said combined slippage ratio differs from k times said combined tension ratio by a predetermined slippage threshold amount, providing a slippage indication that the slippage between the elevator rope and drive sheave is excessive, and otherwise, not providing said slippage indication.

6. A diagnostic method for an elevator having a car and a counterweight connected to said car by a rope driven by a sheave comprising:

measuring the distance, $S_{SU}$, which the rope slips with respect to the sheave over a finite distance, expressed as a ratio of slippage distance to finite distance, with the car traveling upwardly, while empty;

measuring the distance, $S_{SD}$, which the rope slips with respect to the sheave over a finite distance, expressed as a ratio of slippage distance to finite distance, with the car traveling downwardly, while empty;

providing a combined slippage ratio as the ratio of one of said ratios of slippage distance to the other of said ratios of slippage distance;

determining an up ratio of tension in the rope on the car side to tension in the rope on the counterweight side when the car is traveling up;

determining a down ratio of tension in the rope on the car side to tension in the rope on the counterweight side when the car is traveling down;

determining a combined tension ratio as the ratio of one of said tension ratios to the other of said tension ratios;

estimating a factor, k, as the ratio of (a) said combined slippage ratio provided from said distance $S_{SU}$ to said distance $S_{SD}$ measured for a new elevator of the same type as said elevator, to (b) said combined tension ratio;

if a currently-provided value of said combined slippage ratio differs from k times said combined tension ratio by a predetermined slippage threshold amount, providing a slippage indication that the slippage between the elevator rope and drive sheave is excessive, but otherwise not providing said slippage indication;

measuring the distance, $S_{BU}$, required to stop the car when traveling upwardly at rated speed while the car is empty;

measuring the distance, $S_{BD}$, required to stop the car when traveling downwardly at rated speed while the car is empty;

calculating the braking force, $F_{BU}$, required to stop the car while traveling upwardly while empty as $$F_{BU}=[(V_0^2/2)(2M+0.5Q)/S_{BU}]+0.5Qg$$

calculating the braking force, $F_{BD}$, required to stop the car while traveling downwardly while empty as $$F_{BD}=[(V_0^2/2)(2M+0.5Q)/S_{BD}]-0.5Qg$$

where: 2M+0.5Q is the total mass of the car plus counterweight, 0.5Q is substantially the amount of mass by which the mass of the counterweight exceeds the mass of the car when empty, and g is the acceleration of gravity;

comparing the difference between said braking force $F_{BU}$ and said braking force $F_{BD}$ with a predetermined difference threshold magnitude;

if said difference exceeds said difference threshold magnitude, providing a brake difference indication that at least one element of said brake needs adjusting, but otherwise not providing said brake difference indication;

comparing said braking forces $F_{BU}$ and $F_{BD}$ to a predetermined braking force threshold magnitude, and providing a force indication that servicing of the brake is necessary in the event that either said brake force $F_{BU}$ or said brake force $F_{BD}$ is less than said force threshold magnitude; and in response to an occurrence of an elevator car leveling error, providing an indication of a slippage leveling error in response to said slippage indication, if any, providing an indication of a brake difference leveling error in response to said brake difference indication, if any, and providing an indication of a brake force leveling error in response to said brake force indication, if any, but otherwise not providing any of said leveling error indications.

7. A diagnostic method for an elevator having a car and a counterweight connected to said car by a rope driven by a sheave comprising:

measuring the distance, $S_{SU}$, which the rope slips with respect to the sheave over a finite distance, expressed as a ratio of slippage distance to finite distance, with the car traveling upwardly, while empty;

measuring the distance, $S_{SD}$, which the rope slips with respect to the sheave over a finite distance, expressed as a ratio of slippage distance to finite distance, with the car traveling downwardly, while empty;

measuring the distance, $S_{BU}$, required to stop the car when traveling upwardly at rated speed while the car is empty;

measuring the distance, $S_{BD}$, required to stop the car when traveling downwardly at rated speed while the car is empty;

calculating maximum deceleration, $a_{max}$, and minimum deceleration, $a_{min}$, as:

$$a_{max}=V_0^2/2(S_{BD}+S_{SD})$$

$$a_{min}=V_0^2/2(S_{BU}+S_{SU})$$

where $V_0$ is the rated speed of the elevator.

8. A method according to claim 7 further comprising:

comparing said $a_{max}$ and $a_{min}$ to a range of deceleration required by an applicable regulatory elevator code.

9. A diagnostic method for an elevator having a car and a counterweight connected to said car by a rope driven by a sheave comprising:

measuring the distance, $S_{SU}$, which the rope slips with respect to the sheave over a finite distance, expressed as a ratio of slippage distance to finite distance, with the car traveling upwardly, while empty;

measuring the distance, $S_{SD}$, which the rope slips with respect to the sheave over a finite distance, expressed as a ratio of slippage distance to finite distance, with the car traveling downwardly, while empty;

measuring the distance, $S_{BU}$, required to stop the car when traveling upwardly at rated speed while the car is empty;

measuring the distance, $S_{BD}$, required to stop the car when traveling downwardly at rated speed while the car is empty;

calculating the force, $F_{BDF}$, required to stop the car when traveling downwardly, at rated speed, $V_0$, while fully loaded with 125% of rated load, Q, at rated speed as $$F_{BDF}=[(V_0^2/2)(2M+0.5Q)/S_{BU}]-0.5Qg$$

where: 2M+0.5Q is the total mass of the car plus counterweight, 0.5Q is substantially the amount of mass by which the mass of the counterweight exceeds the mass of the car when empty, and g is the acceleration of gravity;

calculating the braking force, $F_{BU}$, required to stop the car while traveling upwardly while empty as $$F_{BU}=[(V_0^2/2)(2M+0.5Q)/S_{BU}]+0.5Qg$$

calculating the braking force, $F_{BD}$, required to stop the car while traveling downwardly while empty as $$F_{BD}=[(V_0^2/2)(2M+0.5Q)/S_{BD}]-0.5Qg$$

comparing said braking forces $F_{BU}$ and $F_{BD}$ to a predetermined braking force threshold magnitude, and providing a force indication that servicing of the brake is necessary in the event that either said brake force $F_{BU}$ or said brake force $F_{BD}$ is less than said force threshold magnitude, but otherwise not providing said force indication;

comparing the difference between said braking force $F_{BU}$ and said braking force $F_{BD}$ with a predetermined difference threshold magnitude;

if said difference exceeds said difference threshold magnitude, providing a brake difference indication that at least one element of said brake needs adjusting, but otherwise not providing said brake difference indication;

providing a combined slippage ratio as the ratio of one of said ratios of slippage distance to the other of said ratios of slippage distance;

determining an up ratio of tension in the rope on the car side to tension in the rope on the counterweight side when the car is traveling up;

determining a down ratio of tension in the rope on the car side to tension in the rope on the counterweight side when the car is traveling down;

determining a combined tension ratio as the ratio of one of said tension ratios to the other of said tension ratios;

estimating a factor, k, as the ratio of (a) said combined slippage ratio provided from said distance $S_{SU}$ and said distance $S_{SD}$ measured for a new elevator of the same type as said elevator, to (b) said combined tension ratio;

if a currently-provided value of said combined slippage ratio differs from k times said combined tension ratio by a predetermined slippage threshold amount, providing a slippage indication that the slippage between the elevator rope and drive sheave is excessive, but otherwise not providing said slippage indication;

in response to an occurrence of an elevator car leveling error, providing an indication of a slippage leveling error in response to said slippage indication, if any, providing an indication of a brake difference leveling error in response to said brake difference indication, if any, and providing an indication of a brake force leveling error in response to said brake force indication, if any, but otherwise not providing any of said leveling error indications; and calculating maximum deceleration, $a_{max}$, and minimum deceleration, $a_{min}$, as:

$$a_{max}=V_0^2/2(S_{BD}+S_{SD})$$

$$a_{min}=V_0^2/2(S_{BU}+S_{SU})$$

where $V_0$ is the rated speed of the elevator.

10. A diagnostic method for an elevator including a car having a car position encoder and a counterweight connected to said car by a rope over a sheave driven by a motor having a brake and a motor position encoder, comprising:

moving said elevator car vertically while empty and when said car is at an arbitrary position, recording the position, $S_{0C}$, indicated by said car position encoder and the position, $S_{0B}$, indicated by said motor position encoder and commanding an emergency stop to be executed by said brake;

then waiting several seconds and thereafter recording the position, $S_{1C}$, indicated by said car position encoder and the position, $S_{1B}$ indicated by said motor position encoder;

calculating the braking distance, $S_B$, as $S_{1B}-S_{0B}$; and calculating the rope slippage distance, $S_s$, as $S_{1C}-S_{0C}-S_B$.

11. A diagnostic method for an elevator including a car and a counterweight connected to said car by a rope over a sheave driven by a motor having a brake and a motor position encoder, comprising:

identifying a first sensible indicator, $P_{R1}$, in a hoistway within which said car moves vertically;

identifying a second sensible indicator, $P_{R2}$, in said hoistway;

providing a distance indication, $P_R$, of the distance between said indicators as $P_{R2}-P_{R1}$;

moving said car vertically in a first direction at rated speed and as said car moves past said first indicator, recording the position, $S_{0B}$, indicated by said motor position indicator and commanding an emergency stop to be executed by said brake;

then waiting several seconds and thereafter recording the position, $S_{1B}$, indicated by said motor position encoder;

next, moving the car vertically in said first direction with low acceleration and low velocity and as said car moves past said second indicator, recording the position, $S_{2B}$, indicated by said motor position indicator;

calculating the braking distance, $S_B$, as:

$$S_B = S_{1B} - S_{0B};$$

and calculating the rope slippage distance, $S_s$, as:

$$S_s = P_p - (S_{2B} - S_{0B}).$$

* * * * *